US006019572A

United States Patent [19]

Cunha

[11] Patent Number: 6,019,572

[45] Date of Patent: Feb. 1, 2000

[54] GAS TURBINE ROW #1 STEAM COOLED VANE

[75] Inventor: Frank J. Cunha, Longwood, Fla.

[73] Assignee: Siemens Westinghouse Power Corporation, Orlando, Fla.

[21] Appl. No.: 09/129,904

[22] Filed: Aug. 6, 1998

[51] Int. Cl.[7] ..... F01D 25/08

[52] U.S. Cl. ..... 415/114; 415/115; 415/178

[58] Field of Search ..... 415/114, 115, 415/116, 176, 178; 416/95, 96 R, 97 R, 96 A

[56] References Cited

U.S. PATENT DOCUMENTS

| | | | |
|---|---|---|---|
| 2,778,601 | 1/1957 | Eckert | 253/39.15 |
| 3,738,771 | 6/1973 | Delarbre et al. | 416/96 |
| 3,819,295 | 6/1974 | Hauser et al. | 416/96 |
| 4,179,240 | 12/1979 | Kothmann | 416/96 R |
| 4,314,442 | 2/1982 | Rice | 60/39.05 |
| 5,320,483 | 6/1994 | Cunha et al. | 415/114 |
| 5,340,274 | 8/1994 | Cunha | 415/115 |
| 5,413,458 | 5/1995 | Calderbank | 415/115 |
| 5,536,143 | 7/1996 | Jacala et al. | 416/96 R |
| 5,743,708 | 4/1998 | Cunha et al. | 415/115 |

*Primary Examiner*—Edward K. Look
*Assistant Examiner*—Liam McDowell
*Attorney, Agent, or Firm*—Eckert Seamans Cherin & Mellott LLC

[57] ABSTRACT

A design for a vane segment having a closed-loop steam cooling system is provided. The vane segment comprises an outer shroud, an inner shroud and an airfoil, each component having a target surface on the inside surface of its walls. A plurality of rectangular waffle structures are provided on the target surface to enhance heat transfer between each component and cooling steam. Channel systems are provided in the shrouds to improve the flow of steam through the shrouds. Insert legs located in cavities in the airfoil are also provided. Each insert leg comprises outer channels located on a perimeter of the leg, each outer channel having an outer wall and impingement holes on the outer wall for producing impingement jets of cooling steam to contact the airfoil's target surface. Each insert leg further comprises a plurality of substantially rectangular-shaped ribs located on the outer wall and a plurality of openings located between outer channels of the leg to minimize cross flow degradation.

14 Claims, 3 Drawing Sheets

GAS TURBINE ROW #1 STEAM COOLED VANE

GOVERNMENT INTEREST

This invention was made with government support under Contract No. DE-FC21-95MC32267, awarded by the United States Department of Energy. The government has certain rights in this invention.

FIELD OF THE INVENTION

The present invention relates generally to gas turbines, and more particularly to a closed-loop cooling system for the first row vane of a gas turbine.

BACKGROUND OF THE INVENTION

Combustion turbines comprise a casing or cylinder for housing a compressor section, combustion section and turbine section. The compressor section comprises an inlet end and a discharge end. The combustion section comprises an inlet end and a combustor transition. The combustor transition is proximate the discharge end of the combustion section and comprises a wall which defines a flow channel which directs the working gas into the turbine inlet end.

A supply of air is compressed in the compressor section and directed into the combustion section. The compressed air enters the combustion inlet and is mixed with fuel. The air/fuel mixture is then combusted to produce high temperature and high pressure gas. This working gas is then ejected past the combustor transition and injected into the turbine section to run the turbine.

The turbine section comprises rows of vanes which direct the working gas to the airfoil portions of the turbine blades. The working gas flows through the turbine section causing the turbine blades to rotate, thereby turning the rotor, which is connected to a generator for producing electricity.

As those skilled in the art are aware, the maximum power output of a gas turbine is achieved by heating the gas flowing through the combustion section to as high a temperature as is feasible. The hot gas, however, heats the various turbine components, such as the transition, vanes and ring segments, that it passes when flowing through the turbine.

Accordingly, the ability to increase the combustion firing temperature is limited by the ability of the turbine components to withstand increased temperatures. Consequently, various cooling methods have been developed to cool turbine hot parts. These methods include open-loop air cooling techniques and closed-loop cooling systems.

Conventional open-loop air cooling techniques divert air from the compressor to the combustor transition to cool the turbine hot parts. The cooling fluid extracts heat from the turbine components and then transfers into the inner transition flow channel and merges with the working fluid flowing into the turbine section. One drawback to open-loop cooling systems is that it diverts much needed air from the compressor, e.g., a significant amount of air flow is needed to keep the flame temperature of the combustor low. It is, therefore, desirable to provide a cooling system that diverts less air from the compressor.

Steam cooling of the vanes of stator blades is not new and has been the subject matter of commonly-assigned U.S. Pat. No. 5,320,483, of which a co-inventor is the inventor of the present invention. In combined cycle operation, steam at several pressure and temperature levels is readily available and it can be used to replace air as the cooling medium to cool the turbine hot parts.

The purpose of the present invention is to improve upon the present state of cooling of stator vanes of a gas turbine, particularly the first row vane. The operational requirements for such a design include a gas pressure range from 400 to 2000 psia, with a gas recovery temperature of approximately 2800° F. operating in the transonic flow regime. The external gas path heat transfer coefficients assume a peak value of 1600 BTU at a point of highest curvature around the airfoil of the vane.

In addition to satisfying the above technical requirements for cooling a first row vane, the present invention is intended to (1) maintain simplicity for ease of casting the vane, (2) reduce the number of manufacturing operations, (3) reduce the number of parts, (4) be interchangeable with other advanced designs of different configuration, (5) use traditional cooling methods, and (6) achieve a minimum low cycle fatigue life. It is thus, desirable, to provide a versatile and effective first row vane design that lowers costs associated with manufacturing and maintenance.

SUMMARY OF THE INVENTION

A design for a vane segment having a closed-loop steam cooling system is provided. The vane segment comprises an outer shroud, an inner shroud and an airfoil. The outer shroud comprises an outer platform having a target surface on an inside surface of its walls exposed to the working gas of the turbine, outer railings situated along edges of the outer platform, a plurality of rectangular waffle structures on the target surface to enhance heat transfer between the outer shroud and cooling steam, an outer cover positioned on the outer railings, and an outer impingement plate situated between the cover and the outer platform to form (i) an outer plenum between the outer impingement plate and the outer cover, and (ii) a relatively small space between the outer impingement plate and the outer platform, the outer impingement plate having a plurality of impingement holes for producing impingement jets of cooling steam to contact the target surface of the outer platform.

The inner shroud comprises similar features as does the outer shroud except for at least one inlet situated on the outer cover for providing cooling steam to the vane segment, and at least one outlet situated on the outer cover for exhausting steam. The airfoil comprises a first end connected to the outer platform, a second end connected to the inner platform, walls having a target surface on an inside surface of the walls, which are exposed to the working gas of the turbine, a plurality of rectangular waffle structures on the target surface of the walls to enhance heat transfer between the airfoil and the cooling steam, and at least one cavity to serve as a passageway for cooling steam to flow between the outer shroud and the inner shroud.

In a preferred embodiment of the invention, a channel system is provided. The channel system comprises a first and a second outer channel system and a first and a second inner channel system. The first outer channel system is located in the outer railings and comprises passageways for steam to flow through the outer railings and at least one hole to provide a passageway for steam to flow into the outer railings from the space between the outer impingement plate and the outer platform.

The second outer channel system is located on the outer platform for exhausting steam and comprises at least one channel for providing a passageway for steam to reach the outlet from the outer railings, and at least one link between the outer railings and the second outer channel system for steam to flow from the outer railings to the second outer channel system. The first and second inner channel systems comprise similar features as do the first and second outer channel systems, but as their names suggest, are situated in the inner shroud.

A key feature of the present invention is where the airfoil further comprises an insert leg located in a cavity. The insert leg comprises a perimeter and a substantial center, and at least one outer channel located on the perimeter, the outer channel having an outer wall and impingement holes on the outer wall for producing impingement jets of cooling steam to contact the target surface.

In a preferred embodiment of the invention, the insert leg further comprises a plurality of substantially rectangular-shaped ribs located on the outer wall disposed in horizontal and vertical orientation and extending between the outer wall and the target surface of the walls of the airfoil, the ribs serving to minimize cross flow degradation of the steam. In another preferred embodiment of the invention, the insert leg further comprises at least two outer channels, at least one center channel located in the substantial center of the insert leg, and a plurality of openings located between the outer channels to minimize cross flow degradation by providing a passageway for the cross flow between the target surface and the outer walls of the outer channels to flow into the center channel.

The present invention provides additional features. Ridges situated on bottom surfaces in the outer railings and the inner railings are provided to enhance heat transfer. Where one cavity at the trailing edge of the airfoil has a triangular cross-section having a base and an apex, obstructions are provided, situated at the base of the triangle and throughout the length of the cavity to increase resistance in that area and divert steam toward the apex of the cavity, which is difficult to cool otherwise. Pins are provided where the outer cover is welded to the outer railings and disposed through the outer cover and the outer railings to mechanically join the two together.

Additional features are provided which affect the area around the inlet and outlet of the outer shroud. Bevels are provided to smooth out the entrances to cavities in the airfoil through which the cooling steam passes after entering the vane segment through an inlet. An additional channel is provided in an inlet to direct some of the cooling steam into the outer railings of the outer shroud to help cool the trailing edge of the outer shroud. A transition piece is also provided in the outlet in the form of a bellows to allow for effects of thermal expansion.

DETAILED DESCRIPTION OF THE PREFERRED EMBODIMENTS

Figure 1:
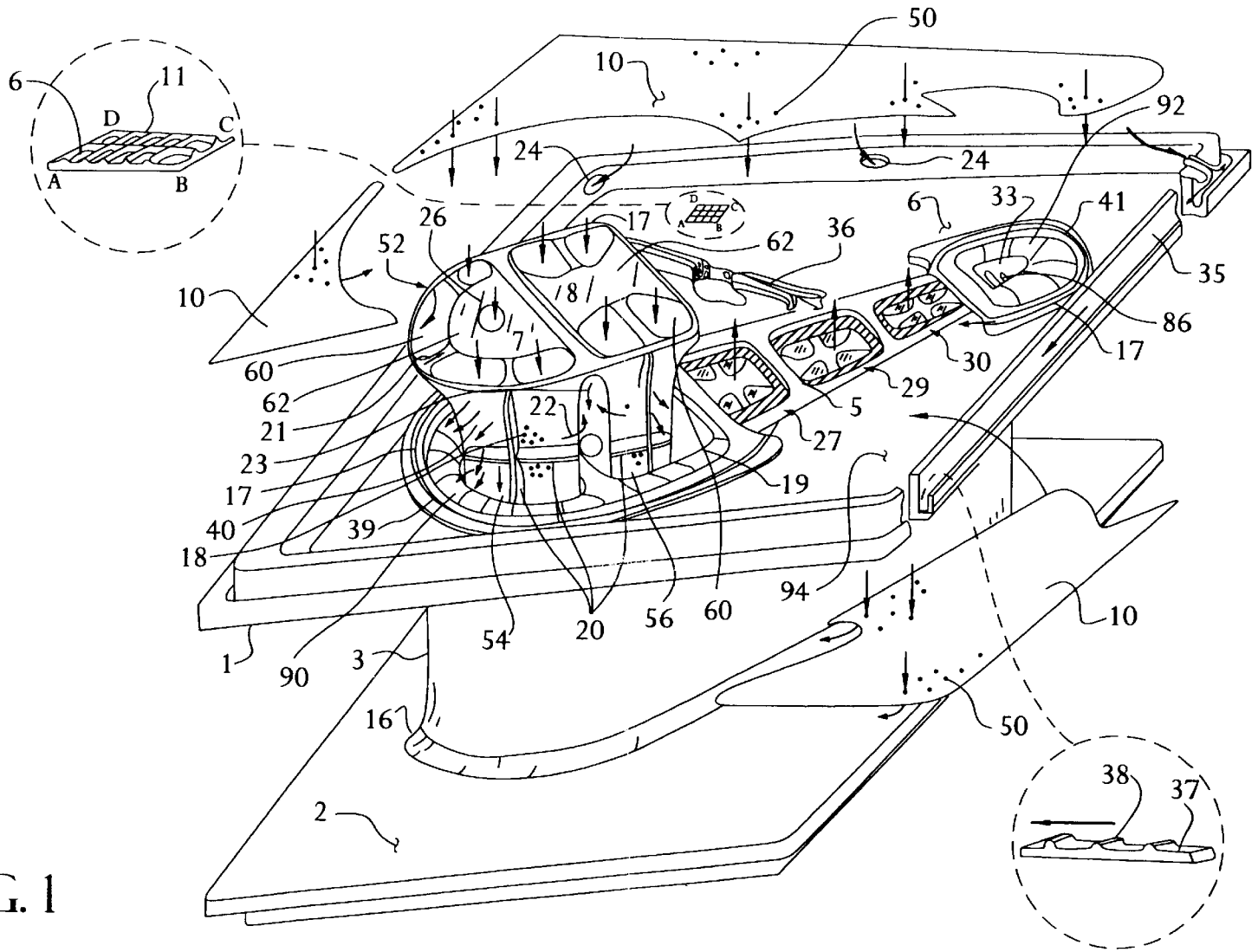
FIG. 1 an isometric view of a vane segment according to the present invention, depicting a partial exploded view of the outer shroud.

Referring to the drawings, there is shown in FIG. 1 an isometric view of a vane segment according to the present invention, depicting a partial exploded view of the outer shroud 1. The vane segment comprises an inner shroud 2, an outer shroud 1 and an airfoil 3, all of which consist of one casting. The outer shroud 1 comprises an outer platform 94, an outer impingement plate 10 for cooling the outer platform 94, an outer channel system and outer railings 35, which have their outer channel system. As shown in FIG. 1, the outer impingement plate 10 comprises three pieces, however, the outer impingement plate 10 preferably consists of only one piece.

The airfoil 3 comprises five structural ribs 5 placed in such a manner as to minimize mechanical stresses due to pressure differences between the inside and outside of the airfoil walls. These ribs 5 also form airfoil cavities 7, 8, 27, 29, 30 and 33 to serve as passageways for cooling steam to flow between the outer shroud 1 and the inner shroud 2.

Figure 2:
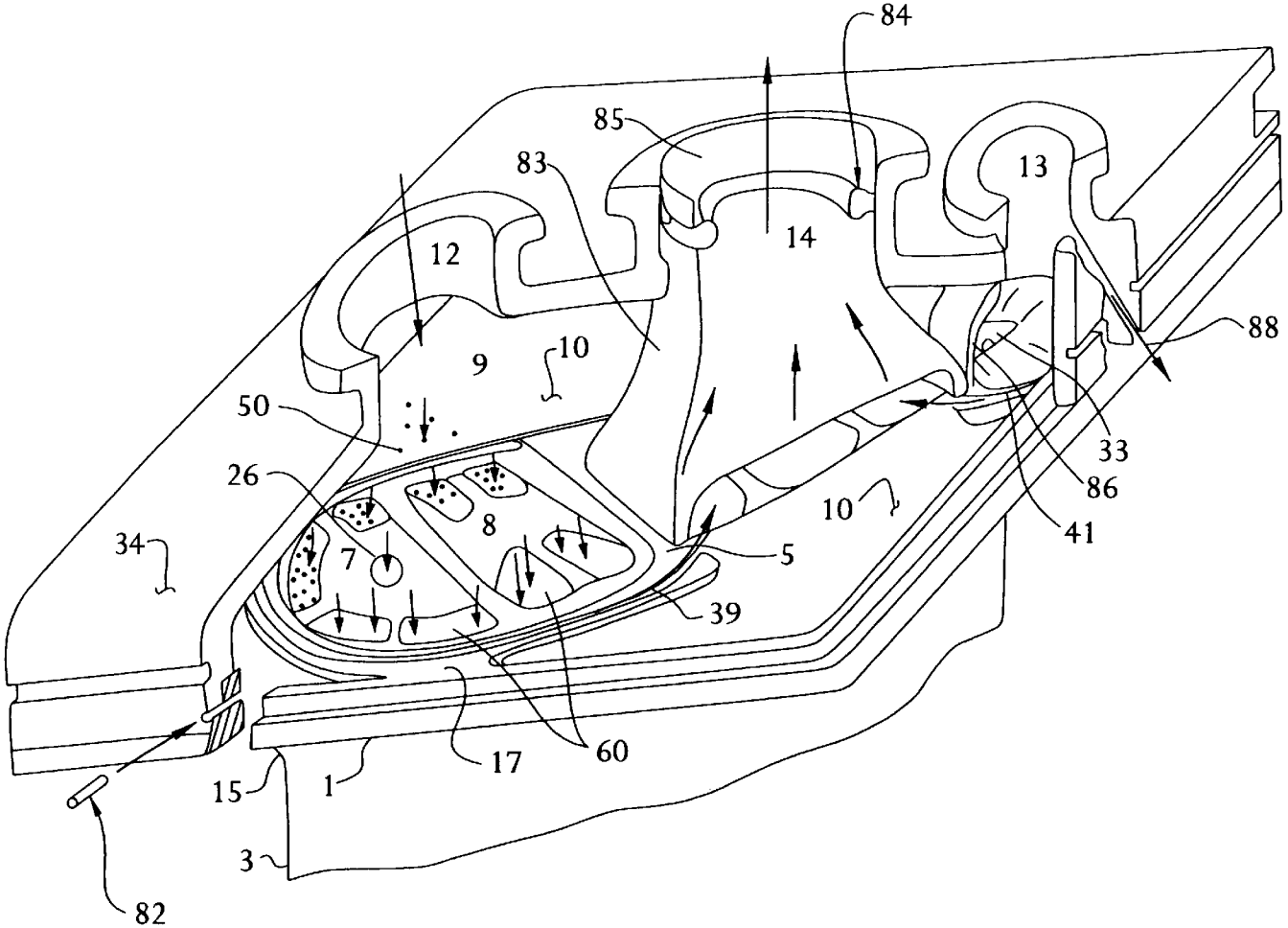
FIG. 2 is a partial cut-out view of an outer shroud of a vane segment according to the present invention.

FIG. 2 shows a partial cut-out view of the outer shroud 1 of a vane segment according to the present invention. Inlets 12 and 13 provide cooling steam and an outlet 14 exhausts steam.

Cooling steam, at approximately 485 psia and 705° F., enters the vane segment at the inlet 12 and fills a plenum 9 in the outer shroud 1. From this outer plenum 9, the cooling steam is allowed to pass through impingement holes 50 located throughout the outer impingement plate 10 for cooling the outer platform 94.

FIG. 1 shows an enlarged view of the target surface 6 of the outer platform 94 of the vane segment. The target surfaces 6 of the outer shroud 1, inner shroud 2 and airfoil 3 have a rectangular waffle structure 11. The waffles 11 are designed to increase the surface area on the target surfaces 6 to enhance the heat transfer from the vane segment to the cooling steam during cooling. The waffles 11 also enhance heat transfer by promoting turbulent flow conditions.

Preferably, the large rectangular sections of waffles 11 are recesses as shown in FIG. 1, however, they may also be protrusions from the target surface 6. Recesses are preferred because a larger pressure differential is required for the flow to pass by the protrusions.

After impingement cooling of the outer shroud 1, the steam flows through holes 24 into the outer channel system of the outer railings 35. The bottom surface 37 of the outer railing channels have ridges 38 to enhance heat transfer.

The outer channel system of the outer railings 35 are connected to the outer channel system of the outer shroud by means of three links 17. The outer channel system comprises a straight channel 36 and two U-shaped channels 39 and 41, one 39 at the leading edge of the airfoil 3 and the other 41 at the trailing edge of the airfoil 3. The channels 39 and 41 direct the flow into the outlet 14, where spent steam is exhausted. Channel 36 provides a direct path from the outer channel system to the outlet 14.

Although a portion of the incoming cooling steam is directed to the outer plenum 9, the majority of the cooling steam proceeds to the first two airfoil cavities 7 and 8 (shown in FIG. 2). As shown in FIG. 1, an impingement insert 52 is placed in cavities 7 and 8. This insert 52 is linked at the outer shroud 1, but has two insert legs 54 and 56, one for each cavity 7 and 8.

Each leg 54 and 56 has impingement holes 18 for cooling the walls of the airfoil 3. The insert 52 in airfoil cavities 7 and 8 is positioned in such a manner as to allow impingement cooling of not only the airfoil walls, but also the fillet areas 15 and 16.

At the outer shroud 1, there are four outer channels 60 in each insert leg 54 and 56 which are open to receive the cooling steam, whereas the center channel 62 is closed. At the inner shroud 2, however, the center channel 62 is open and the outer channels 60 are closed.

Thus, cooling steam flows into the outer channels 60 and is forced through small impingement holes 18 on the outer walls of the outer channels 60 to cool the target surface 6 on the inside wall of the airfoil 3. These impingement jets of cooling steam are then quickly discharged away from the target surface 6 to reduce heat transfer degradation due to cross flow effects on subsequent impingement jets.

Cross flow effects are also minimized by the action of ribs 20 which do not allow long cross flow paths. In addition, openings 21 and 22 minimize cross flow degradation effects by providing a discharge point for the cross flow to escape. Consequently, the flow escapes into the center channel 62, where it continues downward toward the inner shroud 2.

Figure 3:
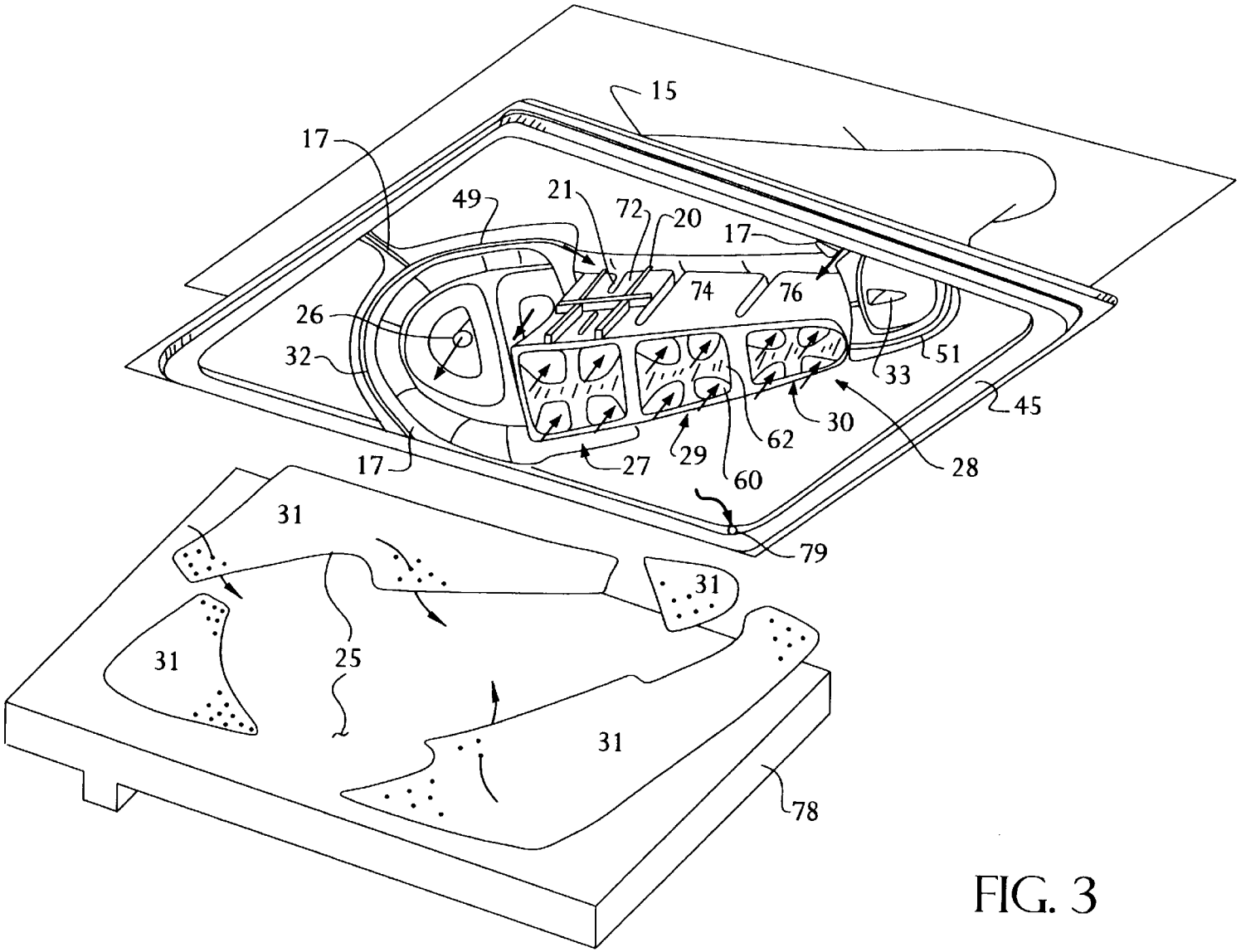
FIG. 3 an isometric view of a vane segment according to the present invention, depicting a partial exploded view of the inner shroud.

The insert legs for remaining cavities 27, 29 and 30 operate in the same manner as insert legs 54 and 56, except that the outer channels 60 are open at the inner shroud 2 and closed at the outer shroud 1, whereas the center channels 62 are closed at the inner shroud 2 and open at the outer shroud 1. FIG. 3 shows an isometric view of a vane segment according to the present invention, depicting a partial exploded view of the inner shroud 2.

Steam from the center channels 62 of insert legs 54 and 56 flows into the inner shroud 2 and is then directed into the aft insert 28, which comprises insert legs 72, 74 and 76, for subsequent impingement cooling of the aft cavities 27, 29 and 30, respectively. In alternative embodiments of the present invention, the number of aft cavities vary.

As shown in FIG. 3, a separate feed 26 or conduit is provided to allow cooling steam to be introduced directly into the inner shroud 2. This feed 26 passes through the center channel 62 of cavity 7, as shown in the figures, however, it may pass through cavity 8 as well as or instead of cavity 7. The steam in feed 26 discharges into inner plenum 25, which lies below the inner impingement plate 31. The steam is then forced upward through the impingement holes 50 in the inner impingement plate 31, which are used for cooling the inner shroud 2 through the action of impingement jets in the same fashion as that described for the outer impingement plate 10.

After impingement cooling of the inner shroud 2, the spent steam flows through holes 79 into the channel system of the inner railings 45 of the inner shroud 2. As with the outer railings 35 of the outer shroud 1, the bottom surface 37 of the inner railing 45 channels have ridges 38 to enhance heat transfer.

Similarly, as with the outer shroud 1, the inner channel system of the railings 45 are connected to the inner channel system of the inner shroud 2 by means of three links 17. The channel system of the inner shroud 2 comprises two U-shaped channels 49 and 51, one 49 at the leading edge of the airfoil 3 and the other 51 at the trailing edge of the airfoil 3. The channels 49 and 51 direct the flow into the outer channels 60 of insert legs 27, 29 and 30 of impingement insert 28. When this steam reaches the outer shroud 1 it exhausts through the outlet 14.

In addition to inlet 12 providing cooling steam to the leading edge of the airfoil 3, inlet 13 provides cooling steam to the cavity 33 at the trailing edge of the airfoil 3, as shown in FIG. 2. Typically, the trailing edge of the airfoil 3 becomes the hottest part of the airfoil 3 and is the most difficult part of the airfoil 3 to cool. Therefore, a separate inlet 13 is needed to cool the trailing edge of the airfoil 3. Inlet 13 is also equipped with a channel 88 to direct some of the cooling steam into the railings 35 of the outer shroud 1 to help cool the trailing edge of the outer shroud 1, which is typically hotter than other parts of the outer shroud 1.

The apex of triangular-shaped cavity 33 is particularly difficult to cool because the steam flow has a tendency to stay clear of the apex. Therefore, obstructions 86 are placed at the base of the triangular-shaped cavity 33 and throughout the length of cavity 33 to increase the resistance in that area and divert the flow toward the apex of the cavity 33. Preferably, as shown in FIG. 1, the obstructions 86 are oriented parallel to the base of the cavity, although this is not required.

The obstructions 86 may be cylindrical rods or of any other shape that creates resistance in that area. The obstructions 86 also add to the structural integrity of the trailing edge of the airfoil 3. As with the steam from the center channels 62 of insert legs 54 and 56, steam from the cooling of cavity 33 flows into the inner shroud 2 and is then directed into the aft insert 28 for subsequent impingement cooling of the aft cavities 27, 29 and 30.

As shown in FIG. 2, the outer plenum 9 is formed between the outer impingement plate 10 and an outer cover 34. Similarly, in the inner shroud 2 (shown in FIG. 3), the inner plenum 25 is formed between the inner impingement plate 31 and an inner cover 78. The outer cover 34 is brazed onto the outer railings 35 of the outer shroud 1. To enhance the strength of the seal, pins 82 are used to mechanically join the outer cover 34 to the railings 35. These pins 82 may be spaced at any number of intervals about the circumference of the joint between the outer cover 34 and the outer railings 35. The inner cover is connected to the inner railings 45 in the same manner.

The outlet 14 for exhausting steam utilizes a transition piece 84 to allow for the effects of thermal expansion. The lower portion 83 of the outlet 14 receives relatively hot steam exhaust, while the steam is relatively cool by the time it reaches the upper portion 85 of the outlet 14. The transition piece 84 acts as a bellows, making the outlet 14 compliant to varying environmental conditions and the effects of thermal expansion.

As shown in FIG. 1, adjacent to channel 39 and surrounding cavities 7 and 8 is a bevel 90 to smooth out the entrance to impingement insert 52 through which the cooling steam passes after entering the outer shroud 1 through the inlet 12. Similarly, adjacent to channel 41 and surrounding cavity 33 is a bevel 92 to smooth out the entrance to cavity 33 for the cooling steam entering the outer shroud 1 through the inlet 13.

The vane segment design of the present invention provides a closed-loop cooling system which thus, diverts less air from the compressor and makes the turbine more efficient. In addition, as an improvement over conventional vane segments, the present invention provides a versatile and effective first row vane design that lowers costs associated with manufacturing and maintenance. The design achieves these benefits by (1) maintaining simplicity for ease of casting, (2) reducing the number of manufacturing operations, (3) reducing the number of parts, (4) being interchangeable with other advanced designs of different configuration, (5) using traditional cooling methods, and (6) achieving a minimum low cycle fatigue life.

In particular, the vane segment design of the present invention provides significant improvements on conventional designs to cool the vane segment. For example, impingement inserts 52 and 28 allow for more efficient cooling of the walls of the airfoil 3. In addition, the waffle structure 11 on the target surfaces 6 of the vane segment, as well as the ridges 38 of the railings 35 and 45, greatly enhance heat transfer between the vane segment and the cooling steam.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. In a turbine, a vane segment having a closed-loop steam cooling system, the vane segment comprising:

an outer shroud comprising:

an outer platform having a target surface on an inside surface of walls of said outer platform exposed to a working gas of the turbine;

outer railings, which are situated along edges of said outer platform;

a plurality of rectangular waffle structures on the target surface to enhance heat transfer between said outer shroud and cooling steam;

an outer cover positioned on said outer railings;

an outer impingement plate situated between said cover and said platform to form (i) an outer plenum between said outer impingement plate and said outer cover, and (ii) a relatively small space between said outer impingement plate and said outer platform, said outer impingement plate having a plurality of impingement holes for producing impingement jets of cooling steam to contact the target surface of said outer platform;

at least one inlet situated on said outer cover for providing cooling steam to the vane segment; and at least one outlet situated on said outer cover for exhausting steam;

an inner shroud comprising:

an inner platform having a target surface on an inside surface of walls of said inner platform exposed to the working gas of the turbine;

inner railings situated along edges of said inner platform;

a plurality of rectangular waffle structures on the target surface of said platform to enhance heat transfer between said inner shroud and the cooling steam;

an inner cover positioned on said inner railings; and an inner impingement plate situated between said inner cover and said inner platform to form (i) an inner plenum between said inner impingement plate and said inner cover, and (ii) a relatively small space between said inner impingement plate an a said inner platform, said inner impingement plate having a plurality of impingement holes for producing impingement jets of cooling steam to contact the target surface of said inner platform; and an airfoil having a first end connected to said outer platform and a second end connected to said inner platform, said airfoil comprising:

walls having a target surface on an inside surface of said walls exposed to the working gas of the turbine;

a plurality of rectangular waffle structures on the target surface of said walls to enhance heat transfer between said airfoil and the cooling steam; and at least one cavity to serve as a passageway for cooling steam to flow between said outer shroud and said inner shroud.

2. The vane segment of claim 1, wherein said outer shroud further comprises:

a first outer channel system in said outer railings comprising passageways for steam to flow through said outer railings;

at least one hole to provide a passageway for steam to flow into said outer railings from the space between said outer impingement plate and said outer platform;

a second outer channel system on said outer platform for exhausting steam, said second channel comprising at least one channel for providing a passageway for steam to reach said outlet from said outer railings; and at least one link between said outer railings and said second outer channel system for steam to flow from said outer railings to said second outer channel system;

wherein said inner shroud further comprises:

a first inner channel system in said inner railings comprising passageways for steam to flow through said inner railings;

at least one hole to provide a passageway for steam to flow into said inner railings from the space between said inner impingement plate and said inner platform;

a second channel system on said inner platform for exhausting steam, said second channel system comprising at least one channel for providing a passageway for steam to reach said outlet from said outer railings; and at least one link between said inner railings and said second channel system for steam to flow from said inner railings to said second channel system.

3. The vane segment of claim 2, wherein said outer railings and said inner railings each have a bottom surface with ridges to enhance heat transfer.

4. The vane segment of claim 1, wherein said airfoil further comprises an insert leg located in said cavity, said insert leg comprising:

a perimeter and a substantial center; and at least one outer channel located on said perimeter, said outer channel having an outer wall and impingement holes on said outer wall for producing impingement jets of cooling steam to contact the target surface.

5. The vane segment of claim 4, wherein said insert leg further comprises:

a plurality of ribs of substantially rectangular shape and located on said outer wall disposed in horizontal and vertical orientation and extending between said outer wall and the target surface of said walls of said airfoil, said ribs serving to minimize cross flow degradation of the steam.

6. The vane segment of claim 5, wherein said insert leg further comprises:

at least two outer channels;

at least one center channel located in said substantial center of said insert leg; and a plurality of openings located between said outer channels to minimize cross flow degradation by providing a passageway for the cross flow between the target surface and said outer walls of said outer channels to flow into said center channel.

7. The vane segment of claim 6, wherein said airfoil further comprises:

at least one structural rib extending from said outer shroud to said inner shroud;

at least two cavities formed by said at least one structural rib;

at least two insert legs, one located inside each cavity; and a plurality of openings located between said insert legs to minimize cross flow degradation by providing a passageway for the cross flow between the target surface and said outer walls of said outer channels to flow into said center channel.

8. The vane segment of claim 7, wherein said airfoil further comprises:

a leading edge and a trailing edge, whereby at least one cavity is located at said leading edge of said airfoil and at least one cavity is located at said trailing edge of said airfoil;

wherein in said insert leg in said at least one cavity at said leading edge:

said at least one center channel is closed at said outer shroud and open at said inner shroud; and said at least two outer channels are open at said outer shroud and closed at said inner shroud;

whereby the cooling steam enters said insert legs at said outer shroud through said at least two outer channels and exits said insert legs at said inner shroud through said at least one center channel; and wherein in said insert leg in said at least one cavity at said trailing edge:

said at least one center channel is open at said outer shroud and closed at said inner shroud; and said at least two outer channels are closed at said outer shroud and open at said inner shroud;

whereby the cooling steam enters said at least one insert leg at said trailing edge at said inner shroud through said at least two outer channels and exits said at least one insert leg at said trailing edge at said outer shroud through said at least one center channel.

9. The vane segment of claim 8 further comprising a conduit extending from said outer cover to the inner plenum for supplying cooling steam directly into the inner plenum, said conduit passing through said at least one center channel of said insert leg in said at least one cavity at said leading edge of said airfoil.

10. The vane segment of claim 1, wherein the airfoil further comprises:

a leading edge and a trailing edge;

a plurality of structural ribs extending from said outer shroud to said inner shroud;

at least one cavity at said leading edge of said airfoil; and one cavity at said trailing edge of said airfoil;

wherein said outer shroud further comprises:

a first inlet proximate said leading edge;

a second inlet proximate said trailing edge;

a first bevel surrounding said at least one cavity at said leading edge to smooth out an entrance to said at least one cavity through which the cooling steam passes after entering the outer shroud through said first inlet; and a second bevel surrounding said one cavity at said trailing edge to smooth out an entrance to said one cavity through which the cooling steam passes after entering the outer shroud through said second inlet.

11. The vane segment of claim 10, wherein said one cavity at said trailing edge of said airfoil has a triangular cross-section having a base and an apex, said cavity further comprises:

obstructions situated at the base of the triangle and throughout a length of said cavity to increase resistance in that area and divert steam toward the apex of said cavity.

12. The vane segment of claim 10, wherein said second inlet further comprises a channel to direct some of the cooling steam into said outer railings of said outer shroud to help cool said trailing edge of said outer shroud.

13. The vane segment of claim 1, wherein said outlet further comprises a transition piece in the form of a bellows to allow for effects of thermal expansion.

14. The vane segment of claim 1, wherein said outer cover is welded to said outer railings and pins disposed through said outer cover and said outer railings are used to mechanically join said outer cover to said outer railings.

* * * * *